United States Patent [19]

Thibodeaux

[11] Patent Number: 4,515,171

[45] Date of Patent: May 7, 1985

[54] HAIR CURLER WITH RETRACTABLE RETAINING BAND

[76] Inventor: Patricia T. Thibodeaux, 6544 St. Ann Ave., Baton Rouge, La. 70811

[21] Appl. No.: 538,501

[22] Filed: Oct. 3, 1983

[51] Int. Cl.[3] ..... A45D 2/00

[52] U.S. Cl. ..... 132/42 R

[58] Field of Search ..... 132/42 R, 42 A

[56] References Cited

U.S. PATENT DOCUMENTS

| | | | |
|---|---|---|---|
| 2,163,894 | 3/1938 | Seidel | 132/40 |
| 2,499,285 | 5/1948 | Stimson | 132/42 |
| 2,874,706 | 7/1957 | Ficicchy | 132/42 |
| 2,896,638 | 7/1959 | Korsmo | 132/42 A |
| 2,938,523 | 7/1956 | Solomon | 132/42 |
| 2,953,140 | 9/1960 | Goff | 132/42 R |
| 2,985,176 | 6/1958 | McKowen et al. | 132/42 |
| 3,045,685 | 7/1962 | Curmier | 132/42 R |
| 3,960,156 | 6/1976 | Thompson | 132/31 |
| 4,108,183 | 8/1978 | Mauro | 132/42 A |
| 4,240,451 | 12/1980 | Thompson | 132/42 A |

*Primary Examiner*—Gregory E. McNeill

*Attorney, Agent, or Firm*—David L. Ray

[57] ABSTRACT

A hair curler having a hollow body and an elastic retaining band connected thereto for retaining the hair against the curler body which retracts into the body of the curler when the curler is being unwound from the treated hair to prevent the band from becoming entangled in the hair. Preferably, the curler body has a series of holes or perforations therein so that curling or setting solutions may travel through the body of the curler through the perforations or holes to thoroughly contact and wet the hair wrapped around the curler.

1 Claim, 3 Drawing Figures

HAIR CURLER WITH RETRACTABLE RETAINING BAND

BACKGROUND OF THE INVENTION

1. Field of the Invention

The present invention relates to hair curlers and in particular to hair curlers with retaining bands to hold the hair against the curler.

2. Description of the Prior Art

Hair curlers are well known in the prior art. Furthermore, there are many hair curling devices disclosed in the prior art that have retaining bands attached thereto for holding the hair to be curled against the roller. Exemplary of such prior art are the following patents:

U.S. Pat. No. 4,240,451 discloses a differential hair engaging retainer to be used in combination with a hair roller and includes a stretchable means extending lengthwise of the hair roller for retaining hair about the roller and forming multiple spaces between the stretchable means and the roller. However, the stretchable means does not retract within the body of the roller.

U.S. Pat. No. 4,108,183 discloses a two part hair curler including an improvement whereby the two parts are provided with a cooperating longitudinal slot and a radial projection which interfit during the telescoping of the two parts together to prevent inadvertent unraveling of the hair. No provision is provided in this patent for retracting the retaining member inside of the body of the curler.

U.S. Pat. No. 3,960,156 discloses a hair roller employing a permanent and reuseable plastic sheet or film, one portion of the sheet being attached to the roller to wind the remainder of the sheet on to the roller when the latter is turned. An elastic retaining cord is disclosed but the cord does not retract into the body of the curler.

U.S. Pat. No. 2,985,176 discloses a curling rod with which a long lasting, sharply defined wave pattern can be formed having a surface of varying curvature and including at least one section having a curvature of short diameter and at least one other section having a curvature of larger diameter so that curls of varying curvature and diameter are formed on the same curling rod. The curling rod contains an elastic band 53 spanning the length of the rod, but the elastic band does not withdraw into the body of the rod.

U.S. Pat. No. 2,938,523 discloses a variable curl platform curler having a platform element rotatably connected to one end of the curler which is swung into position on the first wound part of the hair to form a raised or enlarged diameter portion upon which the remaining part of the swatch of hair is wound for the purpose of forming larger diameter curls in the end of the hair as it approaches the scalp. The platform hair curler also has a retaining strand fixed to one end with a plug connected at its free end, but the retaining strand is not a adapted to be withdrawn into the body of the curler.

U.S. Pat. No. 2,874,706 discloses a hair curler having a hollow body in which a capsule can be inserted and automatically punched during insertion to permit the setting fluid to flow out of the capsule and onto the hair to apply a measured quantity of setting solution to the hair. The curler also incorporates a retaining cord, although the retaining cord is not withdrawn completely into the body of the curler.

U.S. Pat. No. 2,499,285 discloses a hollow hair curler having an elongated perforations running lengthwise of the body to prevent the hair from becoming locked or fitted in the openings and to facilitate the hair sliding free of the curler without any markings on the wrapped curl. The device includes a resilient hair retaining member 24 which does not retract into the body of the curler.

U.S. Pat. No. 2,163,894 discloses a hollow hair curler having a slit therein for insertion of a winding pad having a molded edge which is received inside of the curler body. The curler also contains an elastic band for holding the hair against the curler which does not retract into the body of the curler.

From the above it can be seen that the retaining bands when removed from the curler body do not retract into the body of the curler. Thus, when the curler is being removed from the hair the dangling elastic band can become entangled in the hair if care is not exercised to prevent such entanglement.

It is therefore an object of the invention to provide a hair curler in which the elastic retaining band will retract completely within the body of the curler to prevent the band from becoming entangled in the hair and to expedite the removal of the curler from the hair.

SUMMARY OF THE INVENTION

In accordance with the present invention there is provided a hair curler having a hollow body and an elastic retaining band connected thereto for retaining the hair against the curler body which retracts into the body of the curler when the curler is being unwound from the treated hair to prevent the band from becoming entangled in the hair. Preferably, the curler body has a series of holes or perforations therein so that curling or setting solutions may travel through the body of the curler through the perforations or holes to thoroughly contact and wet the hair wrapped around the curler.

The present invention greatly facilitates the ease with which a curler can be unwound from hair which has been treated with a curling or setting solution. Many of the curlers of the prior art contain elastic retaining bands which can become entangled in the hair if great care is not exercised in removing the curler from the hair. With the curler of the present invention, the retaining band can be removed from one end of the curler after the curling or setting solution is applied to the hair and the hair is dried or otherwise treated, the retaining band retracted completely into the body of the curler, and the curler quickly removed since care need not be exercised to prevent the hair entangling in the retaining band. Furthermore, the curler of the present invention is inexpensive to manufacture and can be made in a variety of exterior configurations to provide the type of curl desired.

BRIEF DESCRIPTION OF THE DRAWINGS

The invention will be more fully understood by reference to the drawings in which.

DESCRIPTION OF THE PREFERRED EMBODIMENTS

Figure 1:
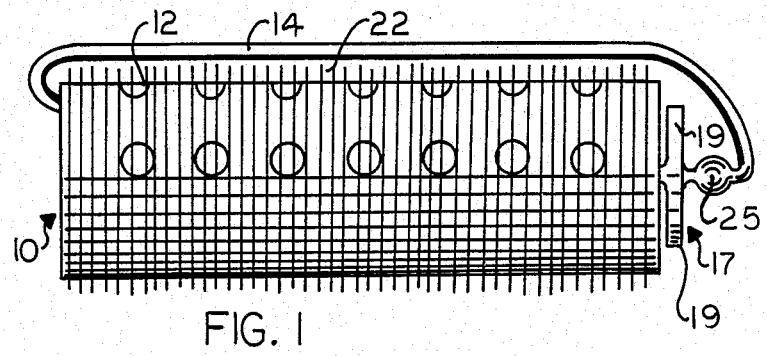
FIG. 1 is a plan view of the curler of the invention with a retaining band clipped onto the end of the curler.

Referring now to FIG. 1, the curler body of the present invention is generally indicated by the numeral 10. The curler includes a hollow cylindrical body member 11 having a series of holes 12 therein. Although the curler body has been shown in the drawings to be cylindrical in shape, the body could have an outer diameter which may increase from the center toward both ends to aid in retaining the curl in place after it is wound thereabout, such as shown in U.S. Pat. No. 2,874,706, which is hereby incorporated by reference. Also, if desired, the outer surface of body 11 could have other shapes such as those shown in U.S. Pat. No. 2,985,176, which is hereby incorporated by reference, as long as the curler body is hollow inside for receipt of a retaining band. In addition, the perforations or holes 12 in the outer body 11 may be circular as shown in the drawings, or they may be square, rectangular, elliptical, or of any other shape desired.

Connected to the hollow interior 13 of curler 10 is an elastic retaining band 14. Elastic retaining band 14 has an interior end 15 and an exterior end 16. As can be seen in the drawing the interior end 15 is rigidly attached to member 16 by tab 15*a*, or any other suitable means. Member 16 is rigidly attached to the inside walls of body 11 by gluing, molding, or any other means known in the art.

At the exterior end 16 of elastic retaining band 14 is a plug generally indicated by the numeral 17 having a tab 18 on the end thereof. Plug 17 contains a circular flange 19 which extends outwardly from tab 18.

At one end of curler 10 is a cover 20 having a hole 21 therein for receipt of tab 18. Hole 21 is slightly smaller in diameter than the outside diameter of tab 18 to achieve a force fit sufficient to hold tab 18 in hole 21. When tab 18 is placed in hole 21 flange 19 rests against the outer surface of cover 20 to hold retaining band 16 in place over the strands of hair 22 held between retaining band 16 and the outer surface of curler body 11. Cover 20 is rigidly attached to the interior of curler body 11 by gluing, molding, or any other means known in the art.

At the other end of curler 10 is a second cover 23. Cover 23 has a hole 24 therein for receipt of elastic retaining band 16. Preferably, cover 23 is recessed into the hollow interior a distance shown in FIGS. 2 and 3 equal to the thickness of flange 19. Cover 23 is attached to the interior of curler body 10 in the same manner as cover 17.

Figure 3:
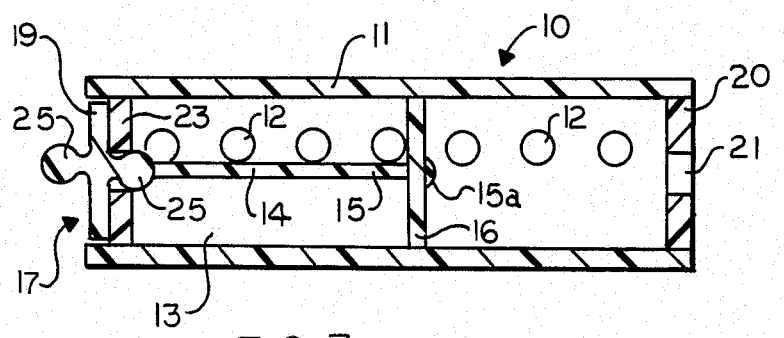
FIG. 3 is a cross-sectional view of the curler of FIG. 1 with the retaining band in the retracted position during removal of the curler from the hair or during storage of the curler.

Furthermore, as can be seen in FIG. 3, when the elastic band is in the retracted position, tab 25 connected to plug 17 is received in hole 24. Hole 24 can be slightly smaller than the outer diameter of tab 25 to achieve a force fit if desired; however, retaining band 16 will be in tension in the position shown in FIGS. 3 and 17 against cover 23.

To use the curler of the present invention, the retaining band 16 is placed in the position shown in FIG. 3. Hair 22 is then placed around the curler and the curler is rolled up on the hair to the position desired. Plug 17 is then removed from the cover 23 and stretched over the hair to the position shown in FIGS. 1 and 2, thereby trapping and retaining the hair between the resilient band 14 and the outer surface of the curler body 11. Setting or curling solution is then applied to the hair and the hair is treated by drying or any other means. After treatment is completed, the plug 17 is removed from the cover 20 of curler 10 and placed in the position shown in FIG. 3. The curler can then be easily removed from the hair without entangling the hair in the retaining band.

Figure 2:
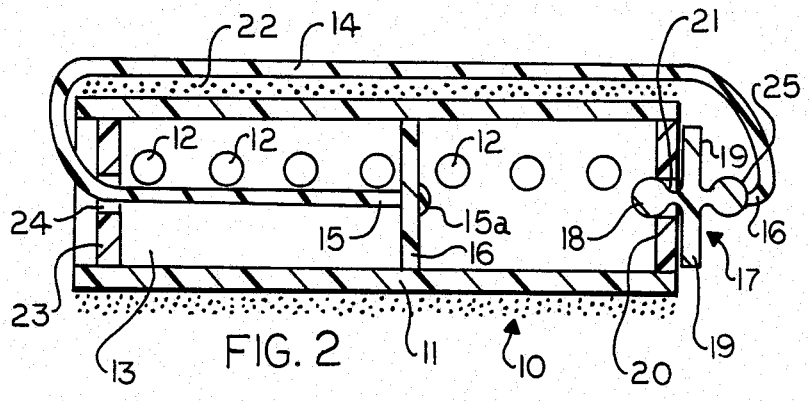
FIG. 2 is a cross-sectional view of the curler shown in FIG. 1.

If desired, plug 17 could be made in a different configuration and any means for holding band 14 in the position shown in FIG. 2 could be utilized. For example, plug 17 could be replaced by a straight pin which could be fitted in a slot located in cover 20. Furthermore, plug 17 could be replaced with a clip such as the clip 27 shown in U.S. Pat. No. 2,449,285, which is hereby incorporated by reference, or by the plugs shown in any of U.S. Pat. Nos. 2,163,894; 2,874,706; 2,938,523 and 2,985,176 which are hereby incorporated by reference.

The curler body 11 and the other structural components of the curler, i.e., 16, 20 and 23, are preferably made from a plastic material such as polyvinchoride or the like. If desired, other rigid materials could also be utilized such as metals such as aluminum or steel. Plug 17 could be made from the same materials as the body 11 and can be affixed to resilient band 14 by any means well known in the art.

Although the preferred embodiments of the present invention have been disclosed and described in detail above, it should be understood that the invention is in no sense limited thereby, and its scope is to be determined by that of the following claims.

What is claimed:

1. A hair curling apparatus comprising:

a. a hollow two ended tubular body member about which hair can be wound to form a curl, said tubular body member having a first end and second end, said hollow tubular body member having a first cover on said first end and a second cover on said second end, each of said two covers having a hole therein, said two covers being parallel, said tubular body having a connecting member located between said two covers and inside said tubular body member, b. an elastic hair retaining band having a first end and a second end, said first end of said elastic hair retaining band being connected to said connecting member on the inside of said hollow tubular body member, the second end of said elastic hair retaining band having connected thereto attachment means having tab means thereon for attaching said second end of said elastic hair retaining band to said second cover of said hollow tubular body member when said elastic hair retaining band is stretched outwardly from said first end of said hollow tubular body means, said elastic hair retaining band extending through said hole in said first cover, said tab means being adapted for receipt in said hole in said second cover, said elastic hair retaining band being adapted to completely retract into the interior of said hollow tubular body member, said elastic retaining band having a length sufficient to extend from the point at which said first end is connected to said connecting member outwardly through said first end of said hollow tubular body over the surface of said hollow tubular body member to said second end of said hollow tubular body means, and to retract completely into the interior of said hollow tubular body member, said hollow tubular body member having holes in the outer surface thereof communicating with the interior thereof.

* * * * *